US009913491B2

(12) United States Patent
Rushforth et al.

(10) Patent No.: US 9,913,491 B2
(45) Date of Patent: Mar. 13, 2018

(54) FLEECE FOR SMOKELESS TOBACCO

(71) Applicant: British American Tobacco (Investments) Limited, London (GB)

(72) Inventors: David Rushforth, London (GB); Eva Sommarstrom, London (GB); Paul Wormald, London (GB)

(73) Assignee: British American Tobacco (Investments) Limited, London (GB)

( * ) Notice: Subject to any disclaimer, the term of this patent is extended or adjusted under 35 U.S.C. 154(b) by 822 days.

(21) Appl. No.: 13/952,408

(22) Filed: Jul. 26, 2013

(65) Prior Publication Data

US 2014/0026912 A1 Jan. 30, 2014

(30) Foreign Application Priority Data

Jul. 30, 2012 (GB) ..... 1213544.8

(51) Int. Cl.
*A24B 13/00* (2006.01)
*A24F 23/02* (2006.01)

(52) U.S. Cl.
CPC ..... *A24F 23/02* (2013.01); *A24B 13/00* (2013.01)

(58) Field of Classification Search
CPC ..... A24F 23/02
See application file for complete search history.

(56) References Cited

U.S. PATENT DOCUMENTS 713,795 A 11/1902 Perky
D48,432 S 1/1916 Bagnulo
1,234,279 A 7/1917 Buchanan
D115,322 S 6/1939 Streit
3,125,098 A * 3/1964 Osborne ..... A24B 15/12 131/355
3,541,752 A 11/1970 Ness
3,989,853 A 11/1976 Forkner
3,990,872 A 11/1976 Cullen
D254,153 S 2/1980 Avins
D298,880 S 12/1988 Graves et al.
5,226,735 A 7/1993 Beliveau
D360,577 S 7/1995 Van Loo
5,449,555 A * 9/1995 Karstens ..... D01F 2/30 428/364
D365,981 S 1/1996 Sullivan
D375,844 S 11/1996 Edwards et al.
D386,398 S 11/1997 Davis
5,934,809 A 8/1999 Marbler
D426,387 S 6/2000 Matsumoto
D430,734 S 9/2000 Bredendick et al.
(Continued)

FOREIGN PATENT DOCUMENTS

EP 1228753 A1 8/2002
EP 2062484 A1 5/2009
(Continued)

OTHER PUBLICATIONS

European Search Report dated Nov. 28, 2013 for European Application No. 13177887.0.
(Continued)

*Primary Examiner* — Cynthia Szewczyk
(74) *Attorney, Agent, or Firm* — McKee, Voorhees & Sease, PLC

(57) ABSTRACT

A fleece for a smokeless tobacco pouch is disclosed. The fleece is formed with apertures.

14 Claims, 6 Drawing Sheets

(56) References Cited

U.S. PATENT DOCUMENTS

| | | | | |
|---|---|---|---|---|
| D432,313 | S | 10/2000 | Matsumoto | |
| 6,145,511 | A * | 11/2000 | Teufel | A24D 3/04 131/331 |
| D451,795 | S | 12/2001 | Ghatlia et al. | |
| D466,702 | S | 12/2002 | Carlson et al. | |
| D489,606 | S | 5/2004 | Lofman | |
| D573,484 | S | 7/2008 | Meek | |
| D578,276 | S | 10/2008 | Pavan | |
| D592,074 | S | 5/2009 | Johnson | |
| D603,719 | S | 11/2009 | Atkin | |
| D624,437 | S | 9/2010 | Leclezio | |
| D643,745 | S | 8/2011 | Hartley | |
| D643,972 | S | 8/2011 | Krohn | |
| D661,104 | S | 6/2012 | Wall | |
| D665,270 | S | 8/2012 | Leclezio | |
| D681,309 | S | 5/2013 | Pavan | |
| D683,497 | S | 5/2013 | Ghiotti et al. | |
| D683,498 | S | 5/2013 | Ghiotti et al. | |
| D690,608 | S | 10/2013 | Neias | |
| D693,961 | S | 11/2013 | Fish | |
| 8,747,562 | B2 | 6/2014 | Mishra et al. | |
| D713,598 | S | 9/2014 | Ghiotti et al. | |
| D732,732 | S | 6/2015 | Rushforth et al. | |
| D735,054 | S | 7/2015 | Neias | |
| D738,745 | S | 9/2015 | Neias | |
| D753,871 | S | 4/2016 | Aspgren | |
| D756,560 | S | 5/2016 | Ghiotti et al. | |
| D756,561 | S | 5/2016 | Ghiotti et al. | |
| D756,562 | S | 5/2016 | Ghiotti et al. | |
| 2004/0018293 | A1 | 1/2004 | Popplewell et al. | |
| 2004/0118422 | A1* | 6/2004 | Lundin | A24B 13/00 131/352 |
| 2005/0061339 | A1* | 3/2005 | Hansson | A24B 15/16 131/352 |
| 2008/0173317 | A1 | 7/2008 | Robinson et al. | |
| 2008/0202536 | A1 | 8/2008 | Torrence et al. | |
| 2008/0302682 | A1 | 12/2008 | Engstrom et al. | |
| 2008/0317911 | A1* | 12/2008 | Schleef | A24B 13/00 426/103 |
| 2009/0152755 | A1* | 6/2009 | Liu | B01D 67/0079 264/115 |
| 2010/0018882 | A1 | 1/2010 | St. Charles | |
| 2010/0129503 | A1 | 5/2010 | Flaherty | |
| 2010/0294291 | A1* | 11/2010 | Robinson | A24B 13/00 131/352 |
| 2011/0139166 | A1* | 6/2011 | Luzenberg, Jr. | A24B 13/00 131/359 |
| 2011/0303232 | A1 | 12/2011 | Williams | |
| 2012/0031416 | A1* | 2/2012 | Atchley | A24B 15/28 131/354 |
| 2012/0073589 | A1 | 3/2012 | Kawata et al. | |
| 2012/0073590 | A1 | 3/2012 | Kawata et al. | |
| 2012/0085360 | A1 | 4/2012 | Kawata et al. | |
| 2012/0103353 | A1 | 5/2012 | Sebastian et al. | |
| 2012/0291794 | A1 | 11/2012 | Kawata et al. | |
| 2014/0026912 | A1 | 1/2014 | Rushforth et al. | |
| 2014/0069829 | A1 | 3/2014 | Evans | |
| 2014/0130813 | A1 | 5/2014 | Strehle | |
| 2014/0255452 | A1 | 9/2014 | Reddick et al. | |
| 2015/0122675 | A1 | 5/2015 | Aspgren | |
| 2016/0073679 | A1 | 3/2016 | Rushforth et al. | |
| 2016/0073680 | A1 | 3/2016 | Rushforth et al. | |
| 2016/0157515 | A1 | 6/2016 | Chapman et al. | |

FOREIGN PATENT DOCUMENTS

| | | | |
|---|---|---|---|
| EP | 2138056 | A2 | 12/2009 |
| GB | 673587 | A | 6/1952 |
| GB | 1111189 | A | 4/1968 |
| GB | 1277826 | A | 6/1972 |
| WO | 2007114742 | A1 | 10/2007 |
| WO | 2008018189 | A1 | 2/2008 |
| WO | 2008135469 | A1 | 11/2008 |
| WO | 2009004486 | A2 | 1/2009 |
| WO | 2009007854 | A2 | 1/2009 |
| WO | 2010014506 | A2 | 2/2010 |
| WO | 2011096256 | A1 | 8/2011 |
| WO | 2011129883 | A1 | 10/2011 |

OTHER PUBLICATIONS

UK Search Report, dated Jan. 4, 2013 for GB1213544.8, filed Jul. 30, 2012.

UK Search Report, dated Sep. 13, 2013 for GB1213544.8, filed Jul. 30, 2012.

British Standards Institution, "Methods of test for nonwovens", website, http://shop.bsigroup.com, last accessed Jun. 23, 2016, 2 pages.

Jones, Chad, "How to Snus and Different Types of Swedish Snus", Snubie.com, posted Jul. 24, 2014 (Retreived from the Internet Sep. 7, 2016). Internet URL:<http://chadizzy1.blogspot.com/2014/07/hot-to-snus-and-different-types-of.html>.

Palsson, Marcus. "Skane Vit by Lundgruns." YouTube.com, posted Feb. 23, 2015 (Retrieved from the Internet Sep. 7, 2016). Internet URL: <https://www.youtube.com/watch?v=i31LyYNo56Q>.

* cited by examiner

FLEECE FOR SMOKELESS TOBACCO

TECHNICAL FIELD

The present invention relates to a fleece that is used to form individual pouches of smokeless tobacco for oral use. The invention also relates to a pouch for smokeless tobacco formed from the fleece of the invention and to a method of manufacturing the fleece.

CLAIM FOR PRIORITY

Applicant hereby claims priority under 35 U.S.C. § 119 to British Patent Application Number GB1213544.8, filed Jul. 30, 2012. The entire content of the aforementioned application is herein expressly incorporated by reference.

BACKGROUND

Snus is a type of smokeless tobacco product which may be for example separated into individual portions and contained within permeable pouches (known as pouched snus). These pouches are referred to as snus pouches and the material used to form the pouches is referred to as a fleece. A snus pouch is typically used by the user placing it between their lip and gums for a period of time.

SUMMARY

The present invention provides an improved fleece, a snus product formed from such fleece, and a method of manufacturing the fleece.

According to the present invention there is provided a fleece for a smokeless tobacco pouch comprising viscose and that is formed with apertures.

In one embodiment, the viscose comprises fibres having a decitex of 1.5 or less.

The mean aperture size may range from 50 to 250 μm in diameter.

The mean diameter of the apertures may be 100 μm or greater.

In one embodiment, at least 50% of the apertures have a diameter of at least 100 μm.

The fleece may comprise a first and a second direction, the second direction is transverse to the direction of the viscose fibres, and the fleece, in a dry state, may exhibit a tensile strength of at least 9 N/5 cm in the second direction.

The fleece may comprise a first direction and a second direction, the second direction is transverse to the direction of the viscose fibres, and the fleece, in a wet state, may exhibit a tensile strength of at least 5 N/5 cm in a second direction.

In one embodiment the fleece comprises a first and a second direction, the second direction is transverse to the direction of the viscose fibres, and the fleece exhibits a bending rigidity of 0.5 μNm or less in the second direction.

According to another aspect of the invention, there is provided a fleece for a smokeless tobacco pouch formed with apertures having a mean aperture size ranging from 50 μm to 250 μm in diameter.

The fleece may optionally comprise apertures having a mean diameter of 100 μm or greater. In some embodiments, at least 50% of the apertures may have a diameter of at least 100 μm. In another embodiment, the fleece may comprise a first and a second direction, and in a dry state exhibit a tensile strength of at least 9 N/5 cm in the second direction. In another embodiment, the fleece may comprise a first and a second direction, and in a wet state exhibit a tensile strength of at least 5 N/5 cm in the second direction. The fleece may also, in some embodiments, comprise a first and a second direction and exhibit a bending rigidity of 0.5 μNm or less in the second direction. The fleece may comprise any optional feature (or combination thereof) disclosed herein, and/or it may comprise viscose.

According to yet another aspect of the invention, there is provided a fleece for a smokeless tobacco pouch formed with apertures having a mean aperture size of at least 50 μm in diameter.

According to a further aspect of the invention, there is provided a fleece for a smokeless tobacco pouch formed with apertures wherein the mean diameter of the apertures is at least 100 μm.

In another embodiment, the fleece for a smokeless tobacco pouch formed with apertures having a mean diameter of at least 50 μm or at least 100 μm may comprise a first and a second direction, and in a dry state exhibit a tensile strength of at least 9 N/5 cm in the second direction. In another embodiment, the fleece for a smokeless tobacco pouch formed with apertures having a mean diameter of at least 50 μm or at least 100 μm may comprise a first and a second direction, and in a wet state exhibit a tensile strength of at least 5 N/5 cm in the second direction. The fleece for a smokeless tobacco pouch formed with apertures having a mean diameter of at least 50 μm or at least 100 μm may also, in some embodiments, comprise a first and a second direction and exhibit a bending rigidity of 0.5 μNm or less in the second direction. The fleece may comprise any feature (or combination thereof) disclosed herein, and/or it may comprise viscose.

According to another aspect of the invention, there is provided a fleece for a smokeless tobacco pouch formed with apertures wherein at least 50% of the apertures have a diameter of at least 100 μm.

In another embodiment, the fleece for a smokeless tobacco pouch formed with apertures wherein at least 50% of the apertures have a diameter of at least 100 μm may comprise apertures having a mean diameter of 100 μm or greater. In a further embodiment, the fleece for a smokeless tobacco pouch formed with apertures wherein at least 50% of the apertures have a diameter of at least 100 μm may comprise a first and a second direction, and in a dry state exhibit a tensile strength of at least 9 N/5 cm in the second direction. In a further embodiment, the fleece for a smokeless tobacco pouch formed with apertures wherein at least 50% of the apertures have a diameter of at least 100 μm may comprise a first and a second direction, and in a wet state exhibit a tensile strength of at least 5 N/5 cm in the second direction. The fleece for a smokeless tobacco pouch formed with apertures wherein at least 50% of the apertures have a diameter of at least 100 μm may also, in some embodiments, comprise a first and a second direction and exhibit a bending rigidity of 0.5 μNm or less in the second direction. The fleece may further comprise any feature (or combination thereof) disclosed herein, and/or it may comprise viscose.

According to a further aspect of the invention, there is provided a fleece for a smokeless tobacco pouch having a first and a second direction, the fleece exhibiting a bending rigidity of 0.5 μNm or less in the second direction.

The fleece may be formed of fibres and the second direction is transverse to the direction of the fibres.

In another embodiment, the fleece may further comprise apertures having a mean aperture size ranging from 50 to 250 μm in diameter. In another embodiment, the fleece may further comprise apertures having a mean diameter of 100

μm or greater. In some embodiments, at least 50% of the apertures may have a diameter of at least 100 μm. In a further embodiment, the fleece may further comprise a first and a second direction, and in a dry state exhibit a tensile strength of at least 9 N/5 cm in the second direction. In a further embodiment, the fleece may further comprise a first and a second direction, and in a wet state exhibit a tensile strength of at least 5 N/5 cm in the second direction. The fleece may comprise any feature (or combination thereof) disclosed herein, and/or it may comprise viscose.

According to another aspect of the invention, there is provided a fleece for a smokeless tobacco pouch, wherein the fleece is softer than a standard fleece.

In another embodiment, the fleece may comprise apertures having a mean aperture size ranging from 50 to 250 μm in diameter. In another embodiment, the fleece may comprise apertures having a mean diameter of 100 μm or greater. In some embodiments, at least 50% of the apertures may have a diameter of at least 100 μm. In a further embodiment, the fleece may comprise a first and a second direction, and in a dry state exhibit a tensile strength of at least 9 N/5 cm in the second direction. In a further embodiment, the fleece may comprise a first and a second direction, and in a wet state exhibit a tensile strength of at least 5 N/5 cm in the second direction. The fleece may also, in some embodiments, comprise a first and a second direction and exhibit a bending rigidity of 0.5 μNm or less in the second direction. The fleece may further comprise any feature (or combination thereof) disclosed herein.

According to yet a further aspect of the invention, there is provided a fleece for a smokeless tobacco pouch comprising viscose fibres having a decitex of 1.5 or less and that is formed with apertures.

In another embodiment, the fleece may further comprise apertures having a mean aperture size ranging from 50 to 250 μm in diameter. In another embodiment, the fleece may further comprise apertures having a mean diameter of 100 μm or greater. In some embodiments, at least 50% of the apertures may have a diameter of at least 100 μm. In a further embodiment, the fleece may further comprise a first and a second direction, and in a dry state exhibit a tensile strength of at least 9 N/5 cm in the second direction. In a further embodiment, the fleece may further comprise a first and a second direction, and in a wet state exhibit a tensile strength of at least 5 N/5 cm in the second direction. The fleece may also, in some embodiments, further comprise a first and a second direction and exhibit a bending rigidity of 0.5 μNm or less in the second direction. The fleece may further comprise any feature (or combination thereof) disclosed herein.

According to another aspect of the invention, there is provided a smokeless tobacco pouch formed with any of the features of the fleece mentioned above.

According to yet a further aspect of the invention, there is provided a snus pouch formed from a fleece comprising apertures, wherein a colour intensity of water in which the snus pouch is immersed is increased by a factor of at least 9 when comparing the colour intensity of the water after 10 seconds of the snus pouch being immersed in the water with the colour intensity after 30 seconds of the snus pouch being immersed in the water.

According to a further aspect of the invention, there is provided a snus pouch formed from a fleece comprising apertures having a faster release rate compared to a pouch formed from a standard fleece.

In one embodiment, the snus pouch formed from the fleece comprising apertures has a release rate that is at least 25% faster compared to a pouch formed from a standard fleece.

In an alternative embodiment, an absorbance reading of a colour intensity of water in which the snus pouch is immersed measured using a Spectrophotometer is at least 2 after 30 seconds of the snus pouch being immersed in water.

In another embodiment, the snus pouch may comprise a fleece further comprising apertures having a mean aperture size ranging from 50 to 250 μm in diameter. In another embodiment, the snus pouch may comprise a fleece further comprising apertures having a mean diameter of 100 μm or greater. In some embodiments, at least 50% of the apertures may have a diameter of at least 100 μm. In a further embodiment, the snus pouch may comprise a fleece further comprising a first and a second direction, and in a dry state exhibit a tensile strength of at least 9 N/5 cm in the second direction. In a further embodiment, the snus pouch may comprise a fleece further comprising a first and a second direction, and in a wet state exhibit a tensile strength of at least 5 N/5 cm in the second direction. The snus pouch may also, in some embodiments, further comprise a fleece further comprising a first and a second direction and exhibit a bending rigidity of 0.5 μNm or less in the second direction. The fleece may further comprise any feature (or combination thereof) disclosed herein.

According to another aspect of the invention, there is provided a method of manufacturing a fleece for a smokeless tobacco pouch, the method comprising the step of hydroentanglement during which apertures are formed in the fleece.

In one embodiment, the step of hydroentanglement includes the use of liquid jets for forming apertures in the fleece.

The method may further comprise the step of adding a binder to the fleece after the step of hydroentanglement.

BRIEF DESCRIPTION OF THE DRAWINGS

Embodiments of the present invention will now be described, by way of example only, with reference to the accompanying drawings, in which.

DETAILED DESCRIPTION

Figure 1:
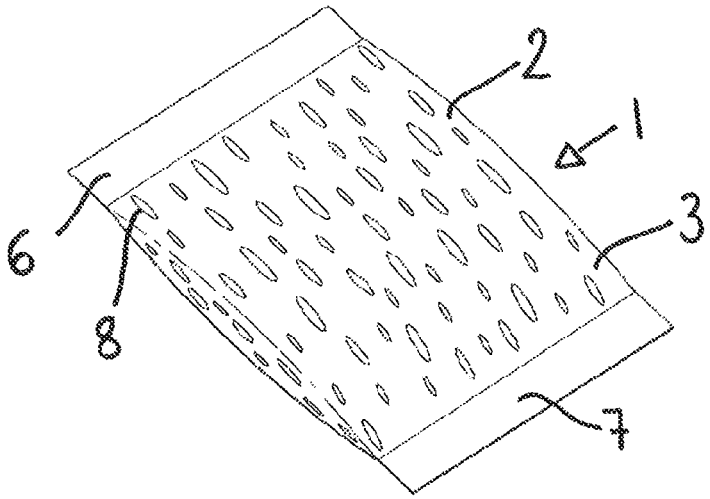
FIG. 1 shows a perspective view of a snus pouch according to an embodiment of the present invention.

Referring now to the drawings, a snus pouch 1 formed from a sheet of fleece 2 according to an embodiment of the present invention is shown in FIG. 1.

The snus pouch 1 comprises a front face 3 and an opposing rear face (not shown). The rear face is formed with a first seal which seals together two longitudinal edges of the fleece. The opposing ends of the snus pouch 1 are formed with second 6 and third seals 7, respectively. The snus pouch may contain snus having approximately equal portions of coarse, medium and fine snus particles. Alternatively the snus pouch may contain other combinations of sizes of snus particles, and may for example use less of the coarse and/or fine particles.

The sheet of fleece 2 is made of non-woven fibres and is formed with a plurality of apertures 8, thus the fleece is referred to as an apertured fleece hereinafter. Alternatively woven fibres may be used. The apertured fleece is manufactured by first carding the fibres so that they are generally parallel to one another. The next step involves the process of hydroentanglement which includes placing the network of fibres between two plates. One of the plates comprises a pattern of holes and is referred to as an embossing plate. High pressure water or alternative fluid is directed through the holes of the embossing plate so as to form apertures in the fleece. The apertures are generally oval in shape and extend in a direction parallel to the fibres.

The hydroentanglement process causes the fibres to be mechanically held together so as to form a non-woven fleece. However, after the hydroentanglement process, a binder may be added to the network of fibres so as to set the non-woven fleece which further increases the mechanical integrity of the apertured fleece. Suitable binders for bonding fibres in a fleece material, such as for example viscose, will be known to those skilled in the art.

The apertured fleece 2 is formed into a long continuous strip wherein the fibres of the apertured fleece are aligned with the longitudinal direction of the strip. This direction is also referred to as a first direction or machine direction. The direction transverse to the first direction is referred to as a second direction or cross direction. The second direction is transverse to the direction of the fibres. As the oval shaped apertures extend in a direction parallel to the fibres as described above, it should be realised that the apertures also extend in the first direction of the apertured fleece 2.

The long continuous strip of apertured fleece 2 is wound onto a reel and snus pouches 1 are formed from the apertured fleece 2 using a snus manufacturing machine, in which the continuous reel of apertured fleece 2 is processed on a continuous basis and which fills, seals and cuts the fleece into individual snus portions. The apertured fleece is passed through the snus manufacturing machine in a direction parallel to the first direction of the apertured fleece 2.

In one embodiment of the present invention, the apertured fleece is made out of 0.9 dtex viscose. However, it should be appreciated that the fleece can alternatively be made out of fibres having a decitex (dtex) of 1.5 or less, for example, the apertured fleece can be made out of 1.2 dtex viscose, 1.0 dtex viscose or 0.7 dtex viscose.

The 0.9 dtex viscose apertured fleece is made according to the hydroentanglement method described above. The apertured fleece was characterised in terms of aperture size, aperture size distribution, bending rigidity, tensile strength, and rate of release of tobacco constituents. Where appropriate, the results were compared to results of a standard snus fleece that was made of viscose fibres according to standard fleece-making processes and which do not have significantly visible apertures therein. This fleece is commercially available from BFF technical fabrics and is identified as "SDH27 Natural". This commercial fleece is referred herein as "standard fleece".

The dimensions of the apertures formed in the apertured fleece of the present invention were measured using a PMI Capillary flow porometer. Briefly, the correlation between the increasing flow rate (l/min) through a single layer of the fleece and the pressure (bar) measured in a sample chamber of the porometer was determined for dry apertured fleece. This was also repeated for wet apertured fleece wherein a Galwick agent having a surface tension of 15.9 mN/m was used to wet the apertured fleece samples. The capillary flow porometer was set to have a tortuosity factor, a shape correction factor, at 0.715. This setting is used when the apertures or pores do not have a regular circular, rectangular or triangular cross-section.

Figure 2:
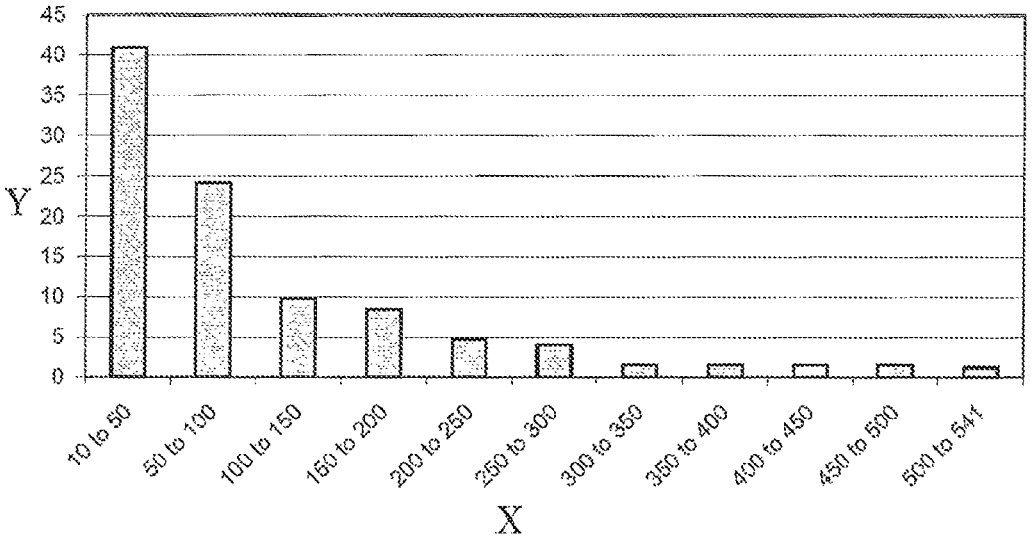
FIG. 2 illustrates an aperture size distribution of a first sample.
Figure 3:
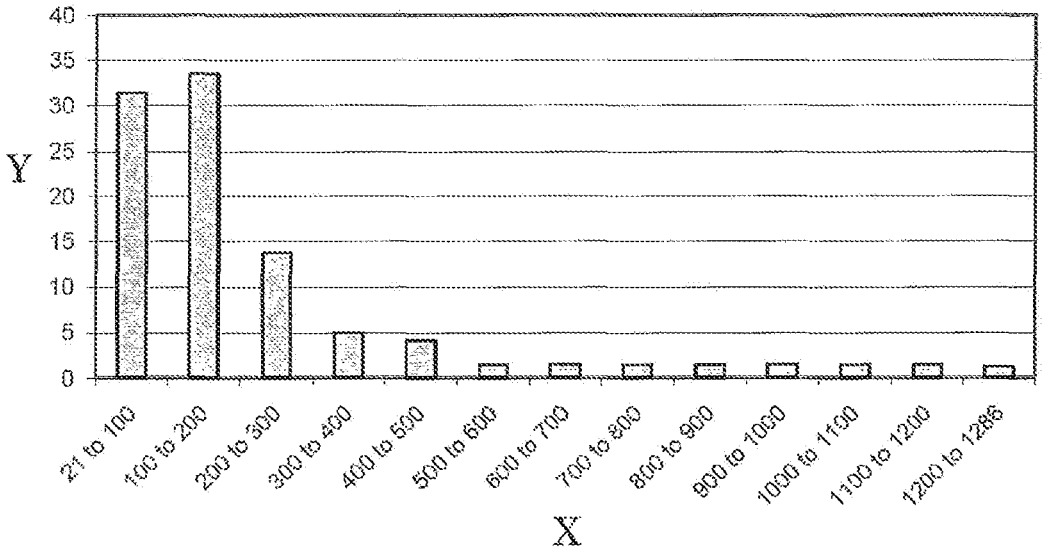
FIG. 3 illustrates an aperture size distribution of a second sample.
Figure 4:
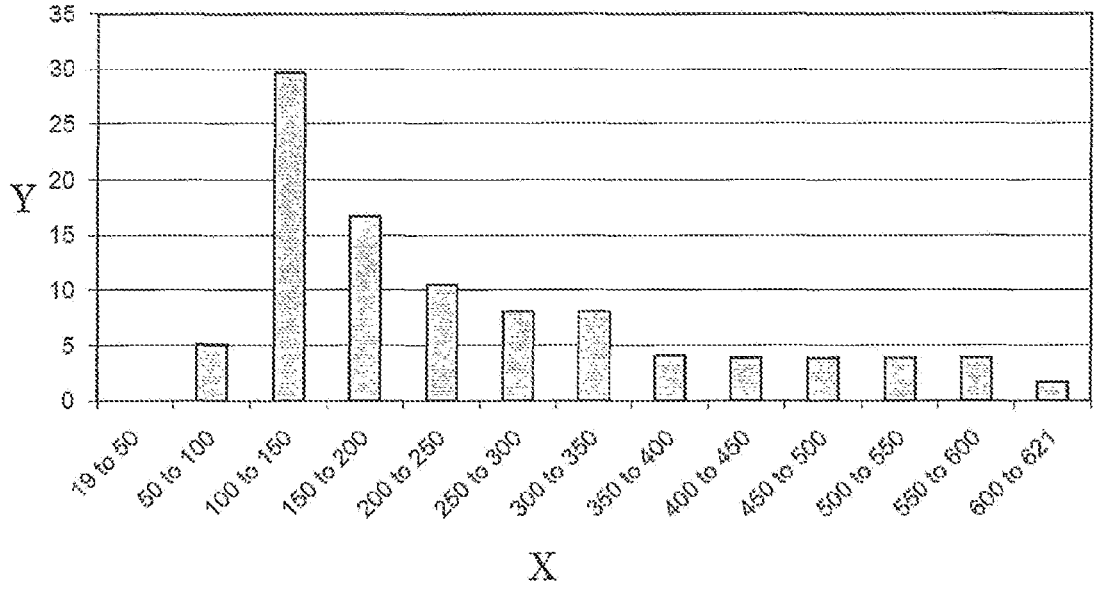
FIG. 4 illustrates an aperture size distribution of a third sample.
Figure 5:
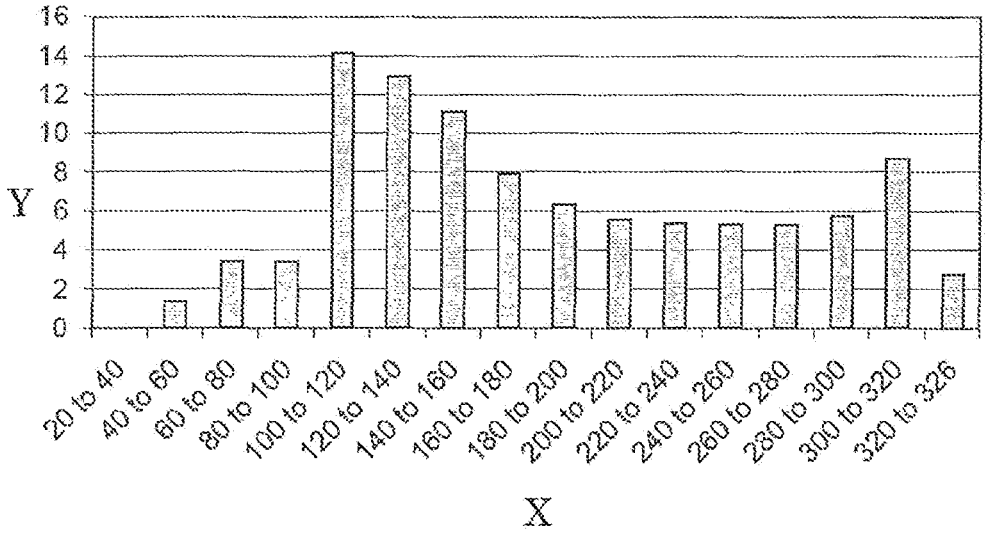
FIG. 5 illustrates an aperture size distribution of a fourth sample.
Figure 6:
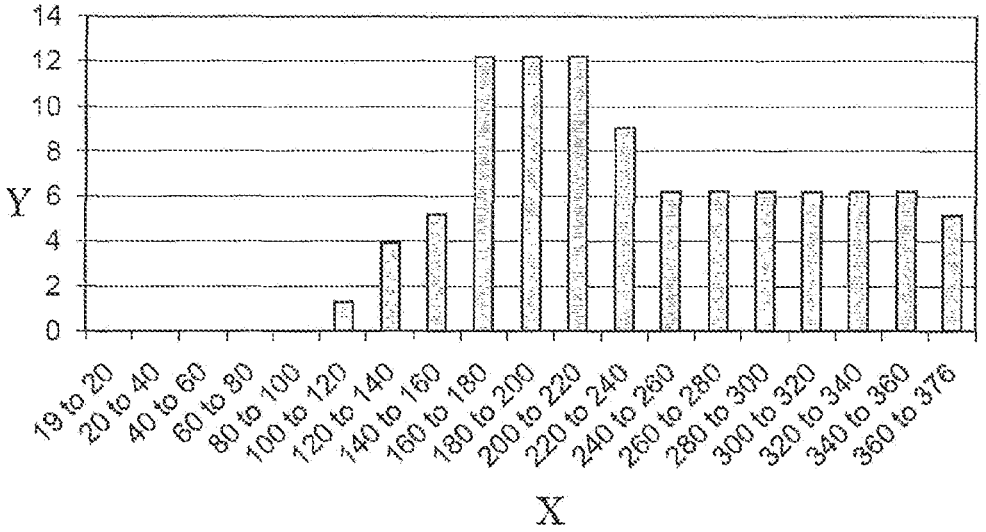
FIG. 6 illustrates an aperture size distribution of a fifth sample.

The capillary flow porometer was operated in accordance with the manufacturer's instructions. The aperture size distribution for five apertured fleece samples are shown in FIGS. 2 to 6, wherein the X-axis represents diameter in microns and the Y-axis represents the aperture size distribution. The results illustrated in FIG. 2 show that at least 50% of the apertures have a diameter of at least 50 μm. Alternatively, at least 55%, 60%, 65%, 70%, 75%, 80%, 85%, 90%, 95% or 100% of the apertures have a diameter of at least 50 μm.

In another embodiment of the invention, at least 50% of the apertures have a diameter of at least 100 μm. For example, at least 55%, 60%, 65%, 70%, 75%, 80%, 85%, 90%, 95% or 100% of the apertures have a diameter of at least 100 μm.

Additional results of the mean diameter of the apertures are shown in the table below.

| Apertured fleece sample | Mean aperture size (μm) | Largest aperture size (μm) |
|---|---|---|
| 1 | 63 | 541 |
| 2 | 138 | 1286 |
| 3 | 195 | 621 |
| 4 | 168 | 326 |
| 5 | 224 | 376 |

The mean diameter of the apertures is at least at least 50 μm, for example, the mean diameter of the apertures is at least 100 μm, 150 μm, 200 μm, 250 μm, 300 μm, 350 μm or 400 μm. In one embodiment, the mean diameter of the apertures ranges from 50 to 250 μm.

The apertured fleece also has 16-24 visible apertures per $cm^2$, and including non-visible apertures the total number of apertures per square centimeter will be higher. In one embodiment, the apertured fleece comprises at least 16 visible apertures per $cm^2$, for example, the apertured fleece comprises at least 17, 18, 19, 20, 21, 22, 23, 24, 25, 26, 27, 28, 29 or 30 visible apertures per $cm^2$.

The arrangement and the characteristics of the apertures in the apertured fleece provide the advantage that the apertured fleece is softer than a standard fleece. A further advantage provided by the present invention is an increased rate of release of constituents through the apertured fleece, including for example constituents from the contained tobacco material and/or flavourants, without significant loss of tobacco material.

Figure 7:
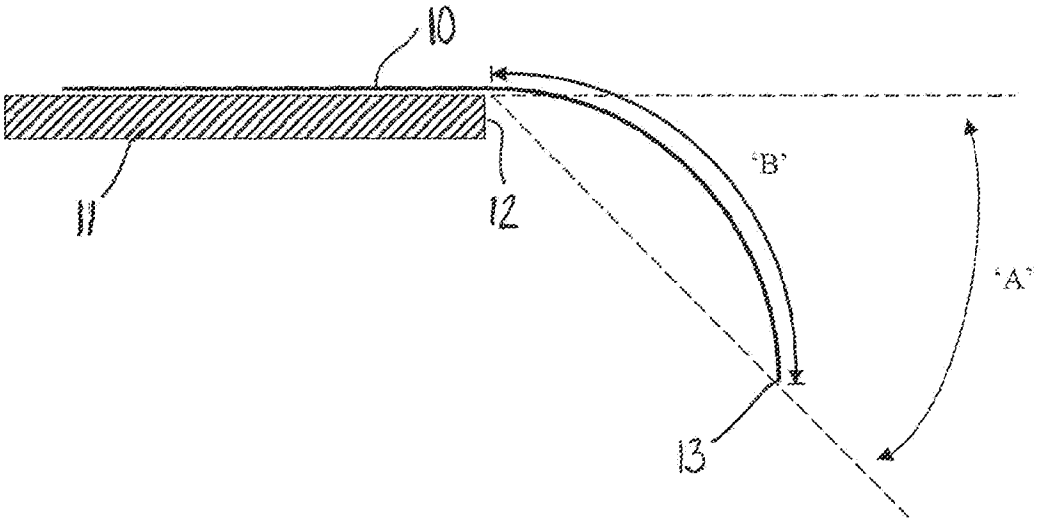
FIG. 7 shows a schematic illustration of a bending rigidity test.

The softness of the apertured fleece was assessed by measuring the bending rigidity of the apertured fleece. The bending rigidity was measured using a FAST-2 bending meter which is schematically illustrated in FIG. 7. Fleece samples were prepared by cutting the fleece into rectangular strips 10 having the dimensions of 50 mm×130 mm. Each fleece sample was placed on a platform 11 such that a portion of the fleece sample was overhanging an edge 12 of the platform 11. Each fleece sample was orientated so that the short 50 mm edges of the fleece sample were parallel to the edge 12 of the platform which the fleece sample was overhanging. The overhang of the fleece sample was adjusted until the leading short edge 13 of the fleece sample was bending under its own mass by 41.5° (see angle 'A' in FIG. 7). The length 'B' of the overhang, referred to as the bending length, was then measured.

The bending length 'B' was measured with the fleece sample facing upwards and downwards giving two bending length values for each fleece sample. The average bending length was then determined and the bending rigidity was calculated as follows;

$$B = W \times c^3 \times 9.81 \times 10^{-6}$$

wherein B=bending rigidity, W=Mass per unit area (g/m$^2$) and c=bending length (mm).

The bending rigidity was determined in both the first and second directions of the apertured fleece. The bending rigidity was also determined for standard fleece. The results of the bending rigidity are shown in the table below.

| | Bending rigidity in first direction (μNm) | | Bending rigidity in second direction (μNm) | |
|---|---|---|---|---|
| Sample | Standard fleece | Apertured fleece of the present invention | Standard fleece | Apertured fleece of the present invention |
| Mean | 17.2 | 9.7 | 1.4 | 0.3 |
| Standard Deviation | 4.2 | 5.3 | 0.6 | 0.1 |
| Lowest value | 11.4 | 5.3 | 0.6 | 0.1 |
| Highest value | 21.8 | 19.5 | 2.3 | 0.5 |

The results show that the apertured fleece of the present invention, exhibits a mean bending rigidity in the first direction of 9.7 μNm, and a mean bending rigidity in the second direction of 0.3 μNm. The standard fleece exhibits a mean bending rigidity in the first and second directions of 17.2 μNm and 1.4 μNm, respectively. These results show that the apertures formed in the fleece according to the present invention, reduces the bending rigidity compared to standard fleece. Therefore, as the bending rigidity of the fleece formed with apertures according to the present invention is lower in both the first and second directions compared to standard fleece, the apertured fleece is softer and may be more comfortable in use.

The results also show that the apertured fleece has a bending rigidity in the first direction of 19.5 μNm or less, for example, the bending rigidity of the apertured fleece in the first direction is 19, 18.5, 18.0, 17.5, 17.0, 16.5, 16.0, 15.5, 15.0, 14.5, 14.0, 13.5, 13.0, 12.5, 12.0, 11.5, 11.0, 10.5, 10.0, 9.5, 9.0, 8.5, 8.0, 7.5, 7.0, 6.5, 6.0, 5.5, 5.0, 4.5, 4.0, 3.5, 3.0, 2.0, 1.5 or 1.0 μNm or less. The bending rigidity of the apertured fleece in the second direction is 0.5 μNm or less, for example, the bending rigidity of the apertured fleece in the second direction is 0.45, 0.4, 0.35, 0.30, 0.25, 0.20, 0.15 or 0.10 μNm or less.

The tensile strength of the apertured fleece was determined in both the first and second directions. The tensile strength was also determined for the apertured fleece in a dry and a wet state. The tensile testing was carried out in accordance with the standard method BS EN 29073-2 (1) which is part of ISO 9073. During the testing, the gauge length was set to 200 mm, each sample had a width of 50 mm and the rate of extension was 100 mm/min using a 100 N load cell. Thus, the unit of the tensile strength measured is N per 5 cm.

The tensile strength was also determined for the standard fleece.

The results of the tensile strength of the apertured fleece and the standard fleece in a dry state are shown in the table below.

| | Tensile strength (N/5 cm) in the first direction, dry. | | Tensile strength (N/5 cm) in the second direction, dry. | |
|---|---|---|---|---|
| Sample | Standard fleece | Apertured fleece of the present invention | Standard fleece | Apertured fleece of the present invention |
| Mean | 59.9 | 54.0 | 8.4 | 10.3 |
| Standard Deviation | 7.1 | 5.6 | 0.5 | 0.5 |
| Lowest value | 55.22 | 47.97 | 7.68 | 9.67 |
| Highest value | 72.2 | 61.9 | 8.9 | 10.9 |

These results show that the apertured fleece has a mean dry tensile strength of 54 N/5 cm in a first direction and 10.3 N/5 cm in the second direction. The mean dry tensile strength of the standard fleece in the first and second directions is 59.9 N/5 cm and 8.4 N/5 cm, respectively. These results indicate that the apertured fleece has a similar tensile strength to the standard fleece and that the formation of apertures does not appear to have a significant effect on the mechanical integrity of the apertured fleece of the present invention.

The results also show that the lowest tensile strength value of the dry apertured fleece in the second direction is as 9.67 N/5 cm. Therefore, in one embodiment the dry tensile strength in the second direction of the apertured fleece is at least 9 N/5 cm, for example, the dry tensile strength of the apertured fleece in the second direction is at least 9.5, 10, 10.5, 11.0, 11.5 or 12 N/5 cm.

The results of the tensile strength of the apertured fleece and the standard fleece in a wet state are shown in the table below.

| | Tensile strength (N/5 cm) in the first direction, wet. | | Tensile strength (N/5 cm) in second direction, wet. | |
|---|---|---|---|---|
| Sample | Standard fleece | Apertured fleece of the present invention | Standard | Apertured fleece of the present invention |
| Mean | 27.4 | 24.8 | 4.4 | 6.1 |
| Standard Deviation | 1.2 | 4.0 | 0.2 | 0.5 |
| Lowest value | 25.84 | 18.8 | 4.07 | 5.59 |
| Highest value | 28.8 | 28.4 | 4.6 | 6.7 |

These results show that the apertured fleece has a mean wet tensile strength of 24.8 N/5 cm in the first direction and 6.1 N/5 cm in the second direction. The mean wet tensile strength of the standard fleece in the first and second directions is 27.4 N/5 cm and 4.4 N/5 cm, respectively. Therefore, these results show that the wet apertured fleece exhibits a tensile strength similar to the wet standard fleece and that the formation of apertures does not appear to significantly affect the mechanical integrity of the apertured fleece of the present invention.

These results also show that the lowest tensile strength value determined for the wet apertured fleece in the second direction is 5.59 N/5 cm. Therefore, the wet tensile strength in the second direction is at least 5 N/5 cm, for example, the wet tensile strength of the apertured fleece in the second direction is at least 5.5, 6.0, 6.5, 7.0, 7.5 or 8.0 N/5 cm.

The rate of release of tobacco constituents from a snus pouch formed from the apertured fleece was also tested and compared to the rate of release of tobacco constituents from a snus pouch formed from standard fleece. In this experiment, Franz Diffusion Cells were adopted. The Franz Diffusion Cells comprised a donor cell and a receptor cell and the method involved placing a pouch, weighing 1 g and containing snus, in the donor cell and using a muslin cloth as a membrane material between the donor cell and the receptor cell. 20 ml of solvent was added to the donor cell and the receptor cell. The solvent used was water at ambient temperature. A snus pouch formed from apertured fleece was placed in the donor cell for various periods of time and the change in colour intensity in the receptor cell over time was measured using a Cary 5000 Spectrophotometer. The spectrophotometer was set at 260 nm and the greater the absorbance reading the greater the release of tobacco constituents into receptor cell. The same experiment was also carried out for a snus pouch formed from standard fleece which contained similar snus as that used for testing the rate of release of the apertured fleece. Thus the particle size distribution, moisture, weight, flavourings and additives of the snus used for the snus pouch formed from the standard fleece were similar to that used for the snus pouch formed from the apertured fleece. Therefore, the results of the two types of snus pouches reflect the presence of apertures in the apertured fleece. The Franz diffusion cells experiment was repeated twice for each type of snus pouch.

Figure 8:
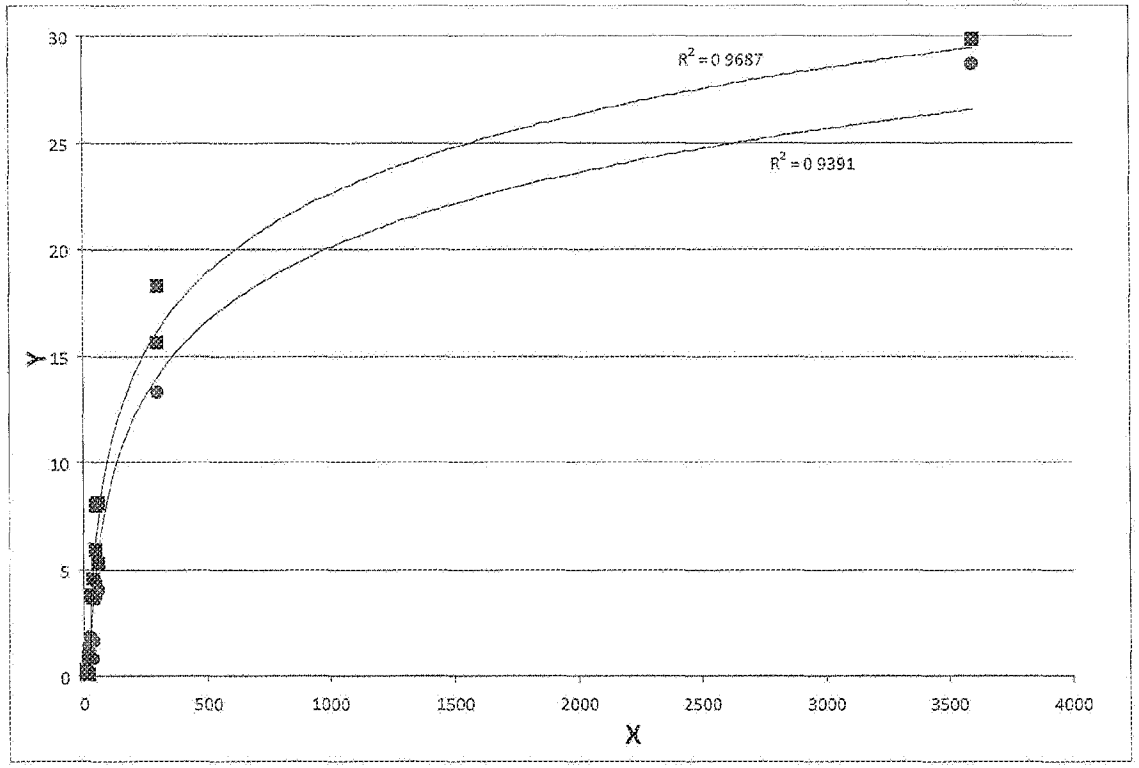
FIG. 8 illustrates results of an experiment assessing the rate of release of tobacco constituents from a snus pouch.
Figure 9:
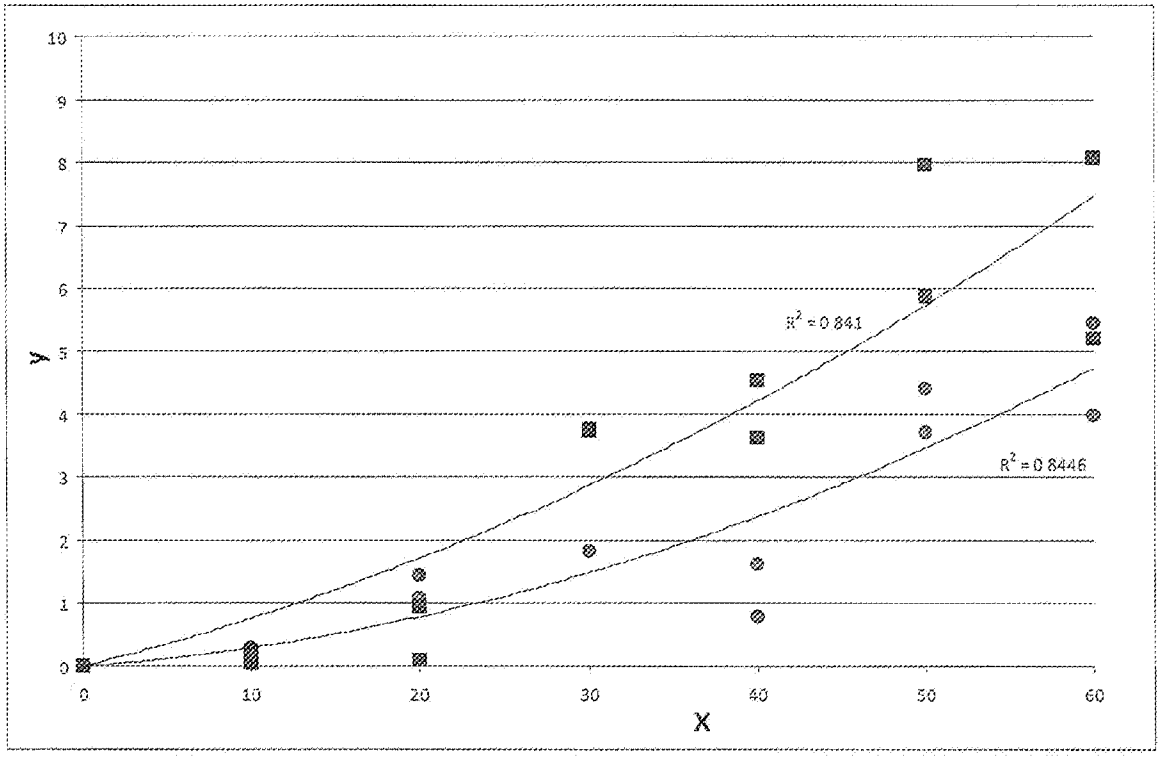
FIG. 9 illustrates results of an experiment assessing the rate of release of tobacco constituents from a snus pouch.

The results of the absorbance readings of the spectrophotometer for snus pouches formed from apertured fleece and standard snus fleece are shown in the table below and in the graphs illustrated in FIGS. 8 and 9. In FIGS. 8 and 9, the Y-axis represents normalised absorbance and the X-axis represents time in seconds, the squares represents readings of snus pouches formed from the apertured fleece and the circles represents readings of the snus pouches formed from standard fleece.

ing of the apertured fleece is 3.73 at 30 seconds whereas the average absorbance reading of the standard fleece is 1.82 at 30 seconds. According to an embodiment of the present invention, the average absorbance reading of a snus pouch formed from the apertured fleece employing the Franz diffusion cells test described above is at least 2, for example, it is at least 2.5, 3.0, 3.5, 4.0, 4.5, 5.0, 5.5, 6.0, 6.5, 7.0, 7.5, 8.0, 8.5, 9.0, 9.5, 10.0, 10.5, 11.0, 11.5, 12.0, 12.5, 13.0, 13.5, 14.0, 14.5 or 15.

The average absorbance reading of the apertured fleece is 3.73 at 30 seconds whereas the average absorbance reading of the standard fleece is 1.82 at 30 seconds. Thus, a snus pouch formed from the apertured fleece has a release rate that is 105% faster than a snus pouch formed from the standard fleece, when measured from 0 to 30 seconds.

In one embodiment, the apertured fleece is configured such that a snus pouch formed from the apertured fleece has a release rate that is at least 25% faster, when measured from 0 to 30 seconds compared to a snus pouch formed from the standard fleece, for example, a snus pouch formed from the apertured fleece has release rate that is at least 30%, 35%, 40%, 45%, 50%, 55%, 60%, 65%, 70%, 75%, 80%, 85%, 90%, 95%, 100%, 105%, 110%, 115%, 120%, 125%, 130%, 135%, 140%, 145%, 150%, 155%, 160%, 165%, 170%, 175%, 180%, 185%, 190%, 195% or 200% faster than the release rate of a snus pouch formed from standard fleece when measured from 0 to 30 seconds.

The absorbance reading of the snus pouch formed from apertured fleece is of an average of 0.155 at 10 seconds, and at 30 seconds the absorbance reading has increased to an average of 3.73, as seen in the table above. Thus, the absorbance reading has increased by a factor of 24 during this period of time. Therefore, according to an embodiment of the present invention, the colour intensity of the water in which the snus pouch is immersed increases by a factor of at least 9 when comparing the colour intensity of the water after 10 seconds with the colour intensity after 30 seconds of the snus pouch being immersed in the water. In another embodiment, the colour intensity of the water in which the snus pouch is immersed is increased by a factor of at least 10, 11, 12, 13, 14, 15, 16, 17, 18, 19, 20, 21, 22, 23, 24, 25, 26, 27, 28, 29, or 30 when comparing the colour intensity of the water after 10 seconds with the colour intensity after 30 seconds of the snus pouch being immersed in the water.

The absorbance reading of the snus pouch formed from the standard fleece has an average absorbance reading of

| | Standard fleece | | | Apertured fleece | | |
|---|---|---|---|---|---|---|
| Time (secs) | First experiment | Second experiment | Average of first and second experiments | First experiment | Second experiment | Average of first and second experiments |
| 10 | 0.116 | 0.302 | 0.209 | 0.257 | 0.054 | 0.155 |
| 20 | 1.441 | 1.071 | 1.256 | 0.931 | 0.091 | 0.511 |
| 30 | 1.821 | 1.821 | 1.821 | 3.737 | 3.715 | 3.726 |
| 40 | 0.791 | 1.608 | 1.199 | 3.618 | 4.530 | 4.074 |
| 50 | 3.692 | 4.386 | 4.039 | 5.864 | 7.963 | 6.914 |
| 60 | 3.977 | 5.446 | 4.712 | 5.202 | 8.081 | 6.641 |
| 300 | 13.311 | 15.606 | 14.459 | 15.626 | 18.256 | 16.941 |
| 3600 | 28.638 | — | 28.638 | 29.822 | — | 29.822 |

The results in the table above and the graphs in FIGS. 8 and 9 indicate that constituents are more rapidly released from a snus pouch formed from apertured fleece according to the present invention than a snus pouch formed from standard fleece. For example, the average absorbance read- 0.209 at 10 seconds. The absorbance reading has increased to an average of 1.82 after 30 seconds. Thus, the absorbance reading of the snus pouch formed from standard fleece has only increased with a factor of 8.7. Therefore, these results show that a snus pouch formed from the apertured fleece has a release rate that is almost three times as high as a snus pouch formed from standard fleece.

It should also be understood that the apertured fleece according to the present invention can also be used for snus pouches containing flavourants. Flavourants add a taste and/or an aroma to the snus pouch and the apertures in the fleece enable flavourants to be released faster compared to a snus pouch formed from standard fleece. As used herein, the terms "flavour" and "flavourant" refer to materials which, where local regulations permit, may be used to create a desired taste or aroma in a product for adult consumers. Flavourants may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The results discussed above in connection with the apertured fleece comprising viscose, show that the size and range of the apertures are sufficiently large to increase the release of tobacco constituents as well as flavourants in comparison to standard fleece. The size and range of apertures are also sufficiently small to retain almost all of the snus particles received in a snus pouch formed form the apertured fleece compared to a snus pouch formed form the standard fleece.

Advantageously, the size and range of apertures do not significantly affect the mechanical properties of the apertured fleece in comparison to the standard fleece. The size and size distribution of the apertures also make the apertured fleece softer in comparison to standard fleece.

The apertured fleece made out of viscose has a thickness of 0.277 to 0.319 mm which is similar to standard fleece having a thickness of 0.262 to 0.283 mm. Therefore, the snus manufacturing machine used for forming snus pouches formed from standard fleece can likely also be used for forming snus pouches formed out of apertured fleece without out the need to significantly adjust the snus manufacturing machine.

Although the above embodiments describe an apertured fleece for a snus pouch, it should be understood that the apertured fleece of the invention could also be used for any other form of smokeless tobacco product. The apertured fleece can also be used for a pouch containing any other plant material or non-tobacco material. Additionally, the apertured fleece is not limited to viscose, it can alternatively be formed of any other suitable material for a pouch filled with smokeless tobacco, for example cotton, cellulose acetate, polylactic acid, polypropylene, modal cellulose or Tencel.

It should be appreciated that apertures may also be introduced in an already formed non-woven or woven fleece. For example, the holes may be formed by heat embossing at temperatures above the melting point of the fibre, or by cutting slits or otherwise puncturing holes in the fleece material. The apertures are not limited to having an oval shape, and may have any desired shape.

The present disclosure contemplates a variety of additional embodiments, including, by way of non-limiting example only:

1. A fleece for a smokeless tobacco pouch comprising viscose and that is formed with apertures.
2. The fleece for a smokeless tobacco pouch according to embodiment 1, wherein the viscose comprises fibres having a decitex of 1.5 or less.
3. The fleece for a smokeless tobacco pouch according to embodiment 1 or embodiment 2, wherein the mean aperture size ranges from 50 to 250 μm in diameter.
4. The fleece for a smokeless tobacco pouch according to any preceding embodiment, wherein the mean diameter of the apertures is 100 μm or greater.
5. The fleece for a smokeless tobacco pouch according to any preceding embodiment, wherein at least 50% of the apertures have a diameter of at least 100 μm.
6. The fleece according to any preceding embodiment, wherein the fleece comprises a first and a second direction and in a dry state exhibits a tensile strength of at least 9 N/5 cm in the second direction.
7. The fleece according to any preceding embodiment, wherein the fleece comprises a first and a second direction, and in a wet state exhibits a tensile strength of at least 5 N/5 cm in the second direction.
8. The fleece according to any preceding embodiment, wherein the fleece comprises a first and a second direction and exhibits a bending rigidity of 0.5 μNm or less in the second direction.
9. A fleece for a smokeless tobacco pouch formed with apertures having a mean aperture size ranging from 50 μm to 250 μm in diameter.
10. The fleece for a smokeless tobacco pouch according to embodiment 9, further comprising any of the features in embodiments 4 to 8.
11. A fleece for a smokeless tobacco pouch formed with apertures having a mean aperture size of at least 50 μm in diameter.
12. A fleece for a smokeless tobacco pouch formed with apertures, wherein the mean diameter of the apertures is at least 100 μm.
13. The fleece for a smokeless tobacco pouch according to embodiment 11 or 12, further comprising any of the features in embodiments 6 to 8.
14. A fleece for a smokeless tobacco pouch formed with apertures wherein at least 50% of the apertures have a diameter of at least 100 μm.
15. The fleece for a smokeless tobacco pouch according to embodiment 14, further comprising any of the features in embodiments 4 or 6 to 8.
16. A fleece for a smokeless tobacco pouch comprising a first and a second direction and exhibits a bending rigidity of 0.5 μNm or less.
17. The fleece for a smokeless tobacco pouch according to embodiment 16, further comprising any of the features in embodiments 3 to 7.
18. The fleece according to any of embodiments 9 to 17, further comprising viscose.
19. A fleece for a smokeless tobacco pouch, wherein the fleece is softer than a standard fleece.
20. The fleece according to embodiment 19, further comprising any of the features described in embodiments 3 to 8.
21. A fleece for a smokeless tobacco pouch comprising viscose fibres having a decitex of 1.5 or less and that is formed with apertures.

22. The fleece for a smokeless tobacco pouch according to embodiment 21, further comprising any of the features described in embodiments 3 to 8.

23. The smokeless tobacco pouch formed from the fleece described in any of embodiments 1 to 22.

24. A snus pouch formed from a fleece comprising apertures, wherein a colour intensity of water in which the snus pouch is immersed is increased by a factor of at least 9 when comparing the colour intensity of the water after 10 seconds of the snus pouch being immersed in the water with the colour intensity after 30 seconds of the snus pouch being immersed in the water.

25. A snus pouch formed from a fleece comprising apertures, wherein the snus pouch has a faster release rate compared to a pouch formed from a standard fleece.

26. The snus pouch formed from a fleece according to embodiment 25, wherein the snus pouch formed from the fleece comprising apertures has a release rate that is at least 25% faster compared to a pouch formed from a standard fleece.

27. A snus pouch formed from a fleece comprising apertures, wherein an absorbance reading of a colour intensity of water in which the snus pouch is immersed, measured using a Spectrophotometer, is at least 2 after 30 seconds of the snus pouch being immersed in water.

28. The snus pouch according to embodiments 24 to 27, wherein the fleece further comprises any of the features described in embodiments 3 to 8.

29. A method of manufacturing a fleece for a smokeless tobacco pouch, the method comprising the step of hydroentanglement during which apertures are formed in the fleece.

30. The method according to embodiment 29, wherein the step of hydroentanglement includes the use of liquid jets for forming apertures in the fleece.

31. The method according to embodiment 29 or 30, wherein the method further comprises the step of adding a binder to the fleece after the step of hydroentanglement.

Although embodiments of the invention have been shown and described, it will be appreciated by those persons skilled in the art that the foregoing description should be regarded as a description of preferred embodiments only and that other embodiments that fall within the scope of the appended claims are considered to form part of this disclosure.

In order to address various issues and advance the art, the entirety of this disclosure shows by way of illustration various embodiments in which the claimed invention(s) may be practiced and provide for superior pouches for smokeless articles. The advantages and features of the disclosure are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and modifications may be made without departing from the scope and/or spirit of the disclosure. As such, all examples, implementations, and/or embodiments are deemed to be non-limiting throughout this disclosure. Also, no inference should be drawn regarding those embodiments discussed herein relative to those not discussed herein other than it is as such for purposes of reducing space and repetition. Various embodiments may suitably comprise, consist of, or consist essentially of, various combinations of the disclosed elements, components, features, parts, steps, means, etc. Some of the disclosed features, elements, implementation, etc., may be mutually contradictory, in that they cannot be simultaneously present in a single embodiment. Similarly, some features are applicable to one aspect of the disclosure, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, function, features, structural, and/or other aspects of the disclosure are not to be considered limitations on the disclosure as defined by the claims or limitations on equivalents to the claims.

The invention claimed is:

1. A smokeless tobacco pouch formed from a fleece comprising:

hydroentangled viscose; and a plurality of apertures formed therein, wherein the viscose comprises fibers having a decitex of 1.5 or less;

wherein the mean aperture size is at least 50 μm;

wherein the fleece comprises a first and a second direction;

wherein the apertures are oval in shape and extend substantially in the first direction;

wherein the fleece exhibits a bending rigidity of not more than 0.5 μNm in the second direction;

wherein the fleece, in a dry state, exhibits a tensile strength of at least 9 N/5 cm in the second direction; and wherein the fleece, in a wet state, exhibits a tensile strength of at least 5 N/5 cm in the second direction.

2. A smokeless tobacco pouch formed from a fleece comprising a fleece material and a plurality of apertures formed therein, wherein the fleece material comprises viscose fibres generally parallel to one another, the apertures being oval in shape and extending in a direction substantially parallel to the fibres.

3. The smokeless tobacco pouch according to claim 2, wherein the viscose fibres having a decitex of 1.5 or less.

4. The smokeless tobacco pouch according to claim 2, wherein the mean aperture size ranges from 50 to 250 μm in diameter.

5. The smokeless tobacco pouch according to claim 2, wherein the mean diameter of the apertures is 100 μm or greater.

6. The smokeless tobacco pouch according to claim 2, wherein at least 50% of the apertures have a diameter of at least 100 μm.

7. The smokeless tobacco pouch according to claim 2, further comprising a first and a second direction and in a dry state exhibiting a tensile strength of at least 9 N/5 cm in the second direction.

8. The smokeless tobacco pouch according to claim 2, further comprising a first and a second direction and in a wet state exhibiting a tensile strength of at least 5 N/5 cm in the second direction.

9. The smokeless tobacco pouch according to claim 2, further comprising a first and a second direction and exhibiting a bending rigidity of 0.5 μNm or less in the second direction.

10. The smokeless tobacco pouch according to claim 2, having a mean aperture size of at least 50 μm in diameter.

11. The smokeless tobacco pouch according to claim 2, which, if the pouch is immersed in water using a Franz diffusion cell, a colour intensity of the water in which the pouch is immersed is increased by a factor of at least 9 when comparing the colour intensity of the water after 10 seconds of the pouch being immersed in the water with the colour intensity after 30 seconds of the pouch being immersed in the water, the colour intensity measured using a spectrophotometer set at 260 nm.

12. The smokeless tobacco pouch according to claim 2, wherein the smokeless tobacco pouch has a faster release rate of constituents compared to a pouch formed from a standard fleece, according to absorbance readings of a 3spectrophotometer set at 260 nm used to measure colour intensity of water in a Franz diffusion cell in which the pouches can be immersed, wherein a standard fleece is made of viscose fibres by standard fleece-making processes and does not have significantly visible apertures therein.

13. The smokeless tobacco pouch according to claim 12, having a release rate that is at least 25% faster compared to a pouch formed from a standard fleece.

14. The smokeless tobacco pouch according to claim 2, which, if immersed in water, produces an absorbance reading of a colour intensity of the water, measured using a Spectrophotometer, of at least 2 after 30 seconds of the smokeless tobacco pouch being immersed in the water.

* * * * *